United States Patent [19]

Igel

[11] Patent Number: 4,735,042

[45] Date of Patent: Apr. 5, 1988

[54] PROCESS AND APPARATUS FOR POSITIONING A SERIES OF ROVING BOBBIN CARRIAGES IN A YARN MANUFACTURING SPINNING MACHINE

[75] Inventor: Wolfgang Igel, Ebersbach/Fils, Fed. Rep. of Germany

[73] Assignee: Zinser Textilmaschinen GmbH, Ebersbach/Fils, Fed. Rep. of Germany

[21] Appl. No.: 4,083

[22] Filed: Jan. 15, 1987

[30] Foreign Application Priority Data

Jan. 15, 1986 [DE] Fed. Rep. of Germany ..... 3600980

[51] Int. Cl.[4] ..... D01H 9/18; B61B 3/00

[52] U.S. Cl. ..... 57/281; 57/268; 57/276; 104/91; 104/249

[58] Field of Search ..... 57/90, 281, 268, 270, 57/276; 104/89, 91, 249–253, 257–260

[56] References Cited

U.S. PATENT DOCUMENTS

| | | | |
|---|---|---|---|
| 3,255,897 | 6/1966 | Lacy et al. | 104/91 X |
| 3,402,675 | 9/1968 | Witt | 104/91 X |
| 3,541,967 | 11/1970 | Birkhead | 104/91 X |
| 3,828,682 | 8/1974 | Klein | 57/281 X |
| 3,935,821 | 2/1976 | Maiek et al. | 57/281 X |
| 4,023,339 | 5/1977 | Laderach et al. | 57/281 X |
| 4,428,299 | 1/1984 | Wakabayashi | 104/91 X |
| 4,438,622 | 3/1984 | Pons | 57/90 X |
| 4,473,997 | 10/1984 | Kawasaki et al. | 57/90 X |
| 4,583,358 | 4/1986 | Krieger et al. | 57/281 |

FOREIGN PATENT DOCUMENTS 1685996 10/1971 Fed. Rep. of Germany .

*Primary Examiner*—John Petrakes

*Attorney, Agent, or Firm*—Karl F. Ross; Herbert Dubno

[57] ABSTRACT

The process for positioning a series of suspended roving bobbin carriages equipped with a plurality of roving bobbins running on at least one rail opposite a plurality of working positions of a yarn manufacturing spinning machine comprises automatically guiding a positively actuated suspended roving bobbin carriage to a predetermined position opposite the working positions and stopping it in that predetermined position during delivery of the roving bobbins. The apparatus for performing this process includes a plurality of positioning elements working together pairwise of which a movable one is movable for positioning the suspended carriage, a carriage mounted one is positioned on one of the roving bobbin carriages and a fixed one is fixed on the stationary part of the spinning machine.

11 Claims, 3 Drawing Sheets

PROCESS AND APPARATUS FOR POSITIONING A SERIES OF ROVING BOBBIN CARRIAGES IN A YARN MANUFACTURING SPINNING MACHINE

FIELD OF THE INVENTION

My present invention relates to a process and apparatus for positioning a series of roving bobbin carriages in a yarn manufacturing spinning machine and, more particularly, to a process and apparatus for positioning a series of suspended roving bobbin carriages opposite a plurality of working positions of a yarn manufacturing spinning machine.

BACKGROUND OF THE INVENTION

It is known to provide a roving-bobbin frame formed by suspended roving bobbin carriages running on an overhead rail whereby the roving bobbins are positioned at a plurality of working positions of a yarn manufacturing spinning machine.

To avoid flaws in the drawing of the roving as a result of bobbin positioning inaccuracies the spatial arrangement of the roving bobbins must be maintained very exactly in the associated working positions.

In the suspended carriage the spacing of the roving spools can be maintained by the rigid structure of the bobbin holder in the bobbin carriage without great difficulty with the required tolerances. It is substantially more difficult to maintain the required spacing between the suspended carriages.

The suspended carriages are usually connected by coupling members to form a chain. These coupling members must be movable to allow the chain to pass readily along tight curves of the rail. The play in these coupling members and the additive tolerances for a large number of carriages lead frequently to the circumstance that an individual carriage or many suspended carriages may not be positioned with the required precision in regard to the set of drafting rolls associated with it.

OBJECTS OF THE INVENTION

It is an object of my invention to provide an improved process and apparatus for positioning a series of suspended roving bobbin carriages in a spinning machine whereby the aforementioned drawbacks and others of the prior art are obviated.

It is also an object of my invention to provide an improved apparatus and process for positioning a series of suspended roving bobbin carriages in a spinning machine in which an exact positioning of the suspended carriages opposite the working positions associated with them is attained so that the roving is fed off of the full roving bobbins completely without error.

SUMMARY OF THE INVENTION

These objects and others which will become more readily apparent hereinafter are attained in accordance with my invention in a process for positioning a series os suspended roving bobbin carriages, each equipped with a plurality of roving bobbins, running on at least one rail opposite a plurality of working positions of a yarn manufacturing spinning machine. They are also attained in an apparatus for performing this process.

According to my invention each of the suspended roving bobbin carriages is guided automatically and positively shifted into a predetermined position opposite the working positions associated therewith and during the delivery of the roving bobbins is stopped in the predetermined position by a formlocking engagement therein.

Advantageously then the suspended carriages correctly positioned opposite the working positions, i.e. the inlets to the drafting rolls, are halted over a definite time period during delivery of the roving from the full roving bobbins so that a very accurate positioning is guaranteed independently of the coupling elements between the individual suspended carriages. Although it is preferred, it need not be necessary in all cases to stop and position each individual suspended carriage. With appropriate tolerances for the suspended carriage couplings when the carriages abut or otherwise are operatively linked together, it may only be necessary to stop and position every second, third, etc. carriage. In the limiting case it is sufficient to position and halt the middle suspended carriage of the linked series and with it the entire series of carriages. In each case the appropriate suspended carriage effects an exact positioning during delivery of the roving bobbins by the process according to my invention.

A transport process for the bobbins of course is already known in which the full bobbins manufactured at at least one first spinning machine are transported to a second spinning machine having a spinning frame for subsequent manufacture of material and the empty bobbins are transported back to the one or more first spinning machines (German Open Patent Application No. 22 27 105). The bobbin holder is a row of carriages approximately equally spaced from each other in which adjacent carriages touch.

One other possibility is that the carriages are held fixed at predetermined positions. In this system, however, suspended carriages are not positioned opposite the working positions associated with them to substitute for the normally stationary roving-bobbin frames.

Among the known structures for ring spinning machines, are those in which the transport carriage for roving bobbin changing devices are exactly positioned by grooves engaged by rollers (as taught in German Open Patent Application No. 1 685 996). This known structure, contrasting with the invention, is not related to the accurate positioning of the suspended roving bobbin carriages opposite the working positions at the beginning of processing.

According to my invention the sliding and stopping of the suspended carriages can occur in a form-locking manner. It is also possible to guide each individual suspended carriage automatically and positively, and during delivery of the roving bobbins to positively stop the carriages each in a predetermined position.

In an apparatus for performing the process according to my invention pairwise positioning elements act together of which a carriage mounted one is positioned on at least one suspended roving bobbin carriage, a fixed one is locally fixed, advantageously on the spinning machine frame, and a movable one is movable to position the suspended carriages against the fixed abutment or stop.

One of the positioning elements can be an engagable member such as a bolt, pin or roller mounted on a suspended carriage and the other is a fork with two spaced prongs movable transverse to the running direction of the suspended carriages. One positioning element can be an engagable member, while the other is a roller rotatable about a pivot axis directed in the longitudinal direction of the suspended carriage. Alternatively the other positioning element can be a tongs like device opening and closing in the running direction of the suspended carriages. The movable positioning element can be mounted on the spinning machine.

Advantageously the apparatus of my invention can also comprise a plurality of positioning elements each in the form of a depression or drop in the rail or track in which the suspended carriages are guided to a place at which the rollers of the suspended carriages rest in the correct position. These depressions advantageously have a linear slope. However these depressions can be bridged by a movable auxiliary piece attached pivotally adjacent the above mentioned rail.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
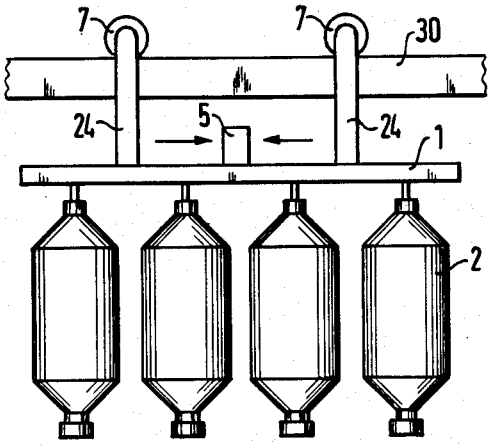
FIGS. 1 and 2 are schematic front elevational views showing a suspended roving bobbin carriage carrying a plurality of roving bobbins according to my invention and the steps of the process for positioning it.

According to FIGS. 1 to 7 and 11 to 14 suspended roving bobbin carriages 1 are mounted by rollers 7 and arms 24 on a rail 30 and can be moved along it. Each suspended roving bobbin carriage 1 can have couplings or links on both ends, which connect it to other roving bobbin carriages, forming a chain thereof jointly suspended in series one after the other.

Each of these suspended roving bobbin carriages 1 is equipped with full roving bobbins 2; in the present case eight roving bobbins 2 are positioned in two rows on each suspended roving bobbin carriage 1. The roving of the roving bobbins is passed through roving guides and is drawn off by a set of drafting rolls at a station at which each roll is precisely positioned. When the roving bobbins are empty the suspended roving bobbin carriages are guided with the empty roving bobbins from the frame and other suspended roving bobbin carriages with full roving bobbins are supplied into their working positions.

For accurate positioning and halting of a newly supplied suspended roving bobbin carriage, according to the invention as illustrated in FIG. 1, pushing forces directed toward each other indicated schematically by both arrows act on the suspended roving bobbin carriages 1 of which one of the suspended carriages pushes forward and positions itself for operation, i.e. the suspended carriage 1 is automatically forced into a predetermined position opposite the working positions associated with it.

Figure 2:
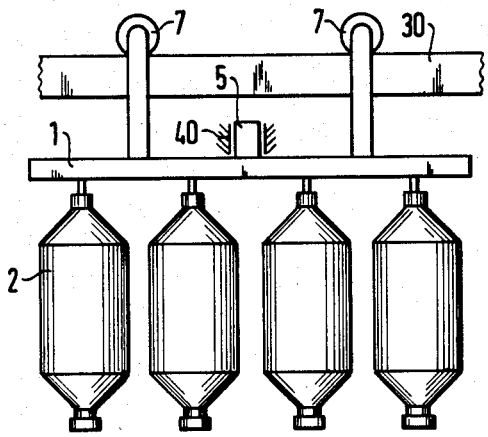

After that in a second process step according to FIG. 2 forces are applied which are opposed to the sliding of the suspended roving bobbin carriage 1 from its operating position and are greater than forces thrusting the suspended carriage from its operating position so that the suspended roving bobbin carriage 1 is halted in this position during the course of the roving bobbins 2. In this embodiment of the invention the suspended roving bobbin carriage can be positioned from a place in front of or behind its operating position.

Figure 3:
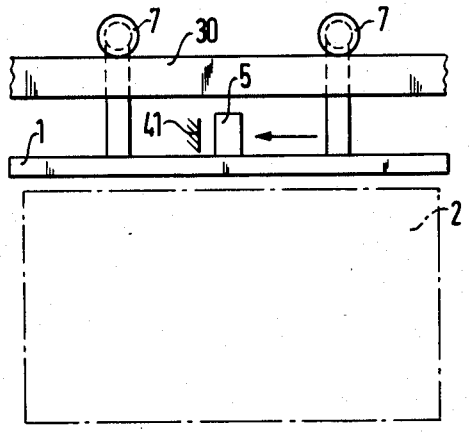
FIGS. 3 and 4 are schematic front views illustrating another embodiment of the process according to my invention.
Figure 4:
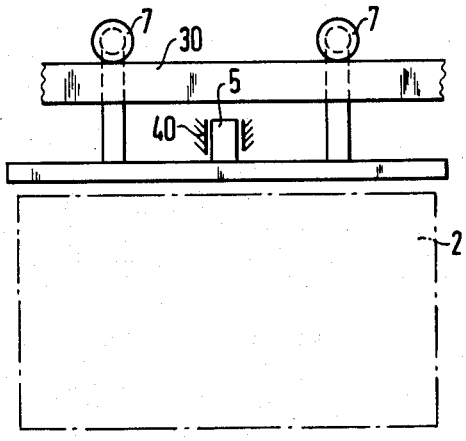

In the embodiment according to FIGS. 3 and 4 the suspended roving bobbin carriage 1 with the roving bobbin 2 is moved by a pushing force in the direction of the arrow in a first process step until it is stopped by a large retaining force.

After that in a second step according to FIGS. 4 the pushing force is maintained at a large value which is larger than the usually occuring forces forcing the suspended carriage from its position. In this embodiment of the invention the suspended roving bobbin carriage must always take an initial position in front of its working or operating position.

Subsequently it is seen that just as the course of the process shown in FIGS. 1 and 2 can be accomplished by the apparatus according to FIGS. 5 to 14, then the course of the process of FIGS. 3 and 4 can be accomplished by the apparatus shown in FIG. 15.

It is thus established that it is not necessary in all cases to stop and to position each individual suspended roving bobbin carriage 1. With suitable tolerances in the suspended carriage coupling it is also the possible to position only each second, third and/or additional suspended carriage. In the limiting case it is sufficient and advantageous to position and stop the central suspended carriage and with it the entire suspended carriage group. This central suspended carriage contains a positioning element 5 which acts with a stopping element 40. Subsequently an apparatus is described in regard to one suspended carriage; it is understood that it can be positioned on several or all the suspended carriages of the spinning machine in the same way.

Figure 5:
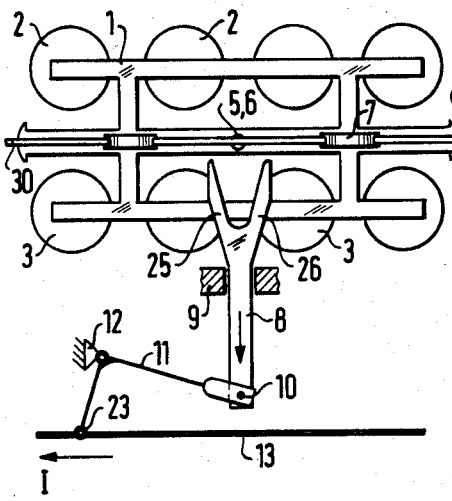
FIG. 5 is a schematic top plan view of a suspended roving bobbin carriage with retracted centered fork.
Figure 6:
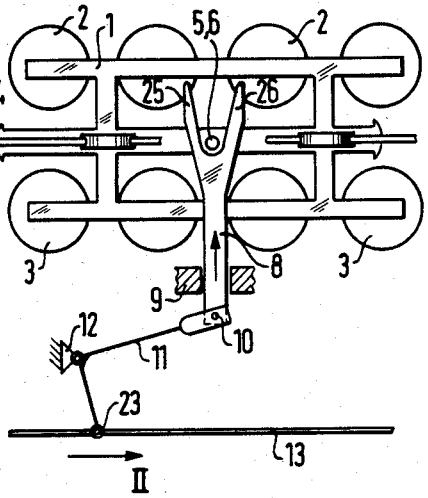
FIG. 6 is a schematic top plan view of the suspended roving bobbin carriage according to FIG. 5 in the stopping configuration.

In the embodiment according to FIGS. 5 and 6 the suspended carriage 1 has a bumper 4 which permits pushing several suspended carriages in series. On the spinning machine a central fork 8 is positioned slidable transverse to the motion direction of the suspended roving bobbin carriage 1 by a bearing member 9. The nonforked end of the central fork 8 is pivotally mounted by a bolt 10 on a bent lever 11. This bent lever 11 is mounted in a locally fixed bearing 12 and is attached by a pivot joint 23 with a longitudinally slidable operating rod 13. The operating rod 13 acts joints to drive all the central forks 8 to be moved on one side of the machine. Every suspended carriage 1 has a bolt or pin 6 as a positioning element 5 according to FIGS. 5 and 6.

Figure 7:
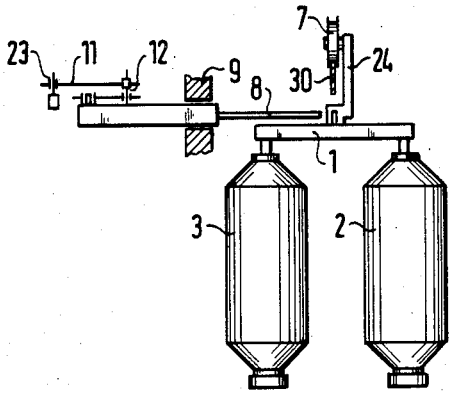
FIG. 7 is a side elevational view showing the structure of the suspended roving bobbin carriage with fork according to FIG. 5.

In the position illustrated in FIGS. 5 and 7 the central fork 8 is pushed back by motion of the slidable operating rod 13 in the direction of the arrow I. With that the suspended carriage 1 can be guided unhindered on the rail 30 into its initial position in the immediate vicinity of its operating position.

The suspended roving bobbin carriage with the full roving bobbins now is approximately in a position in which the drafting roll entrance can be provided with roving from the full roving bobbins (analogous to FIGS. 1 to 3) and the common operating rod 13 moves according to FIG. 6 in the direction of the arrow II, whereby the central fork 8, which is movable transverse to the running direction of the suspended carriage 1, engages with the bolt 6 by pivoting the bent lever 11 and positions the suspended carriage 1 according to FIG. 6 opposite the working position associated with it and stops it.

The central fork 8 is advantageously provided with divergent dovetail prongs 25 and 26 to push the bolt 6 and with it the suspended roving bobbin carriage 1 centrally and subsequently to stop it. The central fork 8 also proceeds according to the process illustrated in FIGS. 1 and 2 to position and stop the suspended carriage 1.

Figure 8:
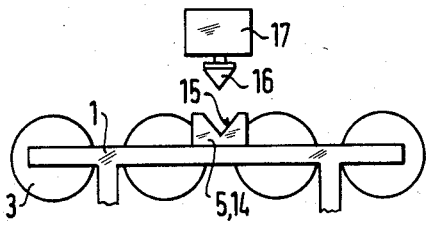
FIG. 8 is a partially cutaway top plan view of an alternative embodiment of the structure in my invention.

With the design according to FIG. 8 each suspended carriage 1 is laterally equipped with a bearing piece 14 provided with an angular recess 15 as a positioning element 5. Each individual suspended carriage position in the spinning machine has a movable positioning head 16 engaging with and stopping in the recess 15 movable transverse to the running direction of the suspended carriage 1 which is driven by a drive element 17.

In the position illustrated in FIG. 8 the suspended carriage 1 can run freely. The suspended carriage 1 equipped with the full roving bobbins 2 and 3 is found similarly in the exact position, the drive element 17 is operated for example hydraulically or electromagnetically, whereby the positioning head 16 moves transverse to the motion direction of the suspended roving bobbin carriage and analogously to the course of the process according to FIGS. 1 and 2 engages in a recess 15 of the bearing piece 14 and with it positions the suspended roving bobbin carriage 1 centrally and stops it.

Figure 9:
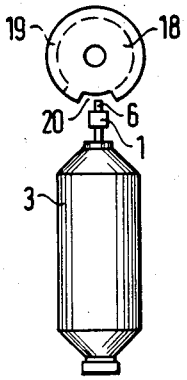
FIG. 9 is a side elevational view of yet another embodiment partially cutaway.
Figure 10:
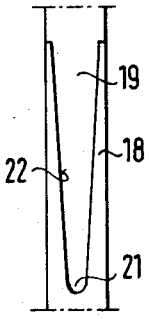
FIG. 10 is a planar projection of the peripheral surface of a roller positioner for the suspended carriage according to my invention.

One other possibility for positioning and stopping of the suspended roving bobbin carriage 1 is illustrated in the vicinity of the working positions associated with it in FIGS. 9 and 10. Here above the suspended roving bobbin carriage 1 a roller 18 is rotatably but not slidably positioned; the shaft has a continuous longitudinal groove 20 and a circumferential groove 19 in a position spaced from the suspended carriage 1.

In the not-stopped position the bolts 6 or pins move in the longitudinal groove 26 which is wider than the diameter of the bolts 6. The peripheral groove 19 has a wedge shape 22 according to FIG. 10 and can end in a peak 21 of a wedge. At the peak 21 or at the narrow end the inner diameter of the wedge 22 corresponds to the diameter of the bolts 6.

To position and stop according to FIG. 9 the roller 19 rotated in the clockwise direction whereby a bolt 6 is engaged by a peripheral groove 19 and is moved inside the wedge shape portion 22 until the bolt 6 reaches the peak 21 of the groove 19. Here the bolt 6 and the suspended carriage 1 is positioned so that the delivery of the full roving bobbins 3 can occur at the entrance of the set of drafting rolls.

In all the previously described structures the movable components of the positioning device in the spinning machine are mounted locally fixed. The positioning elements 5 and 14 are found on the movable suspended roving bobbin carriage 1. In kinematic reversal it is also possible to provide the suspended carriage or carriages with movable engaging elements and to provide the positioning elements locally fixed on the spinning machine. For motion of the engaging elements shafts, pinions or toothed rods, electrical or hydraulic or pneumatic drive elements and/or push or pull rods can be used.

Figure 11:
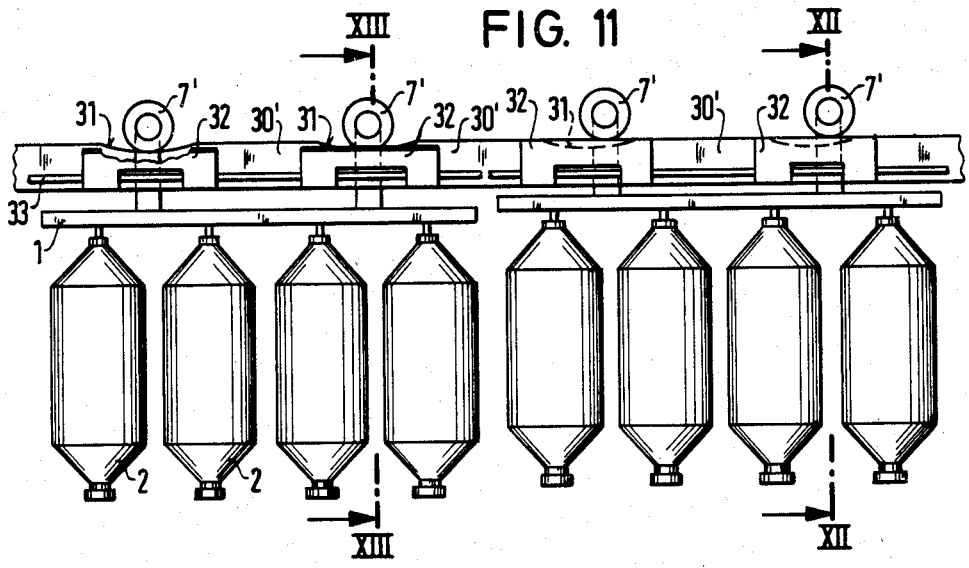
FIG. 11 is a front elevational view of an additional embodiment.
Figure 12:
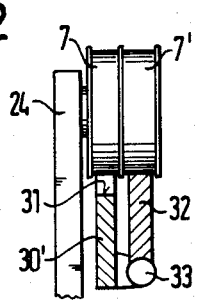
FIG. 12 is a cross sectional view taken along the section line XII—XII in FIG. 11.
Figure 13:
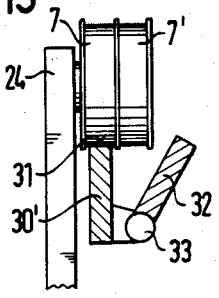
FIG. 13 is a cross sectional view taken along the section line XIII—XIII in FIG. 11.

In the embodiment according to FIGS. 11 to 13 the rail 30' carrying the suspended carriage 1 has depressions or sunken regions 31 which are at the positions at which the running rollers 7' of the suspended carriages 2 stand in the correct position, i.e. in the vicinity of the working positions. According to FIGS. 12 and 13 a movable auxiliary piece 32 is positioned near the depressions which is pivotable on a shaft 33 according to FIGS. 12 and 13.

According to FIG. 11 the auxiliary pieces 32 are pivotable to the right in the way shown in FIG. 12 so that the suspended carriage 1 can be moved by both parallel rollers 7 and 7' on the rail 30' without experiencing a positioning or stopping. When by rotation of the shaft 33 the auxiliary piece 32 is swung away according to FIG. 13, the rollers 7' are no longer supported by the auxiliary piece 32 and the rollers 7 slide into the depressions 31 which have advantageously linear slope as seen in FIG. 11. In the bottom of the depression 31, i.e. illustrated as the leftmost position in FIG. 11, the suspended roving bobbin carriage 1 is positioned and stopped, i.e. the carriages find themselves at the working position in regard to the processsing of the roving bobbin.

Figure 14:
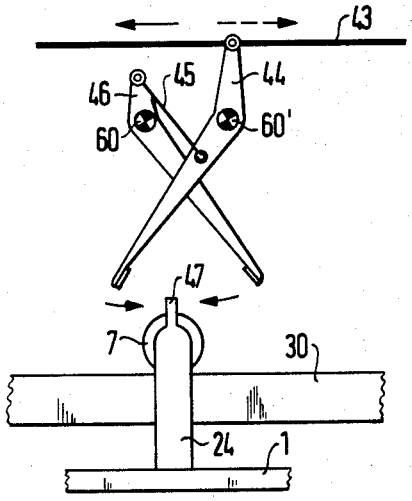
FIGS. 14 and 15 are front elevational views partially cutaway of two additional embodiments of my invention.

In the system of FIG. 14 a tongs like device is used for positioning and stopping which comprises twin levers 44 and 46 which are pivoted about pivot point 60 and 60' and are attached to each other with a coupling member 45. The arm 24 on which the the suspended carriage 1 is supported and which carries the roller 7 has a pin 47. When the suspended carriage 1 is in the illustrated position according to FIG. 14, by motion of a rod 43 the lever 44 and by the coupling piece 45 the lever 46 can be closed in a tongs like manner on the pin 47 so that the suspended carriage 1 experiences a positioning and stopping by these motions. By motion of the rod 43 in the dot-dash arrow direction this stopping is canceled.

Figure 15:
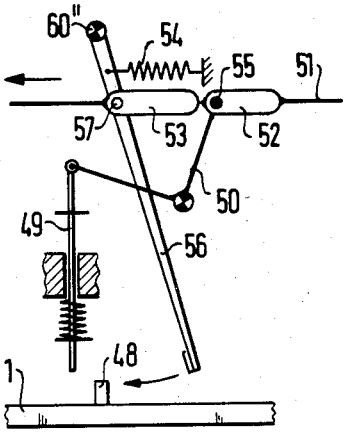

In the design according to FIG. 15 an apparatus for accomplishing the process as seen in FIGS. 3 and 5 is illustrated. By motion of a push rod 51 in the direction of the arrow a pin 49 under force of a spring is depressed. It forms with that the stop 41 shown in FIG. 3. Further the rod 51 is acted on by a pin 57 in the linkage 53 at the end of it so that the lever 56 swings in the clockwise direction about the pivot point 60'' and thus a pin 48 presses against the pin 49 acting like stop 41 on the suspended carriage 1. The position of the linkage 52 and 53 is so designed that the pin 49 is moved by a bent lever 50 and the pin 55 and after that the preparatory motion for the lever 56 occurs by the pin 57 through the end region of the linkage 53.

In each embodiment of the present invention it is guaranteed that an exact positioning and stopping of the suspended carriage or carriages 1 at the entrance position of the set of drafting rolls is possible in an easy way so that misdrawing of the roving resulting in inaccurate or undesirable roving running is satisfactorily avoided.

I claim:

1. A method of positioning full roving bobbins opposite a plurality of working positions to be fed with roving of a yarn-manufacturing spinning machine, said method comprising:

(a) suspending a plurality of full roving bobbins from a bobbin carriage with a spacing between said bobbins corresponding to a spacing of said positions from one another along said machine which has a number of said positions greatly in excess of the number of working positions to be serviced by a respective carriage;

(b) displacing said carriage along said machine past working positions thereof on a rail extending longitudinally along said machine until said carriage is in a region of working positions to be serviced thereby; and (c) positively immobilizing said carriage in said region by displacing into positive form-fitting engagement with a member of said carriage at least one locking element fixedly positioned with respect to said region and actuated from a location alongside the path of the carriage along the rail, whereby all of the bobbins of said carriage are simultaneously precisely positioned opposite respective working positions at said region.

2. An apparatus for precisely positioning full roving bobbins opposite respective working positions to be fed with roving of a yarn-manufacturing spinning machine having a multiplicity of said working positions spaced apart longitudinally in a rectilinear direction along said machine, said apparatus comprising:

a rail extending along said machine in said direction above a level of the working positions thereof;

a plurality of bobbin carriages shiftable along said rail each having a respective engagement member fixed thereon;

a plurality of full roving bobbins, lesser in number than that of the positions of said machine, suspended from each bobbin carriage with a spacing between said bobbins corresponding to a spacing of said positions from one another along said machine;

for each group of working positions equal in number to a number of working positions capable of being serviced by the roving bobbins suspended from each carriage, at least one movable locking element fixedly positioned with respect to a region of said machine provided with the respective group and actuated from a location alongside the path of the carriages along the rail to positively and form-fittingly engage a respective member and immobilize the respective carriage so that all of the roving bobbins of the respective immobilized carriage are simultaneously precisely positioned opposite respective working positions at said region; and means for displacing said carriages along said rail.

3. The apparatus defined in claim 2 wherein said element is a fork with two spread prongs movable transverse to the running direction of said carriage.

4. The apparatus defined in claim 3 wherein said member is a pin.

5. The apparatus defined in claim 3 wherein said member is a roller.

6. The apparatus defined in claim 2 wherein said element is a roller rotatable about a pivot axis directed in the longitudinal direction of said bobbin carriages.

7. The improvement apparatus defined in claim 2 wherein said element is a tongs-like device opening and closing in the direction of displacement of said carriages.

8. The apparatus defined in claim 2 wherein said element is mounted on said spinning machine.

9. An apparatus as defined in claim 2 wherein said rail has depressions in which rollers of said carriages are receivable for positioning said carriage in the correct locations for the roving bobbin thereof.

10. The improvement according to claim 9 wherein said depressions each have a linear slope.

11. The improvement according to claim 10 wherein said depressions are bridgable by a movable auxiliary piece mounted pivotally adjacent said rail and forming said element.

* * * * *